US009399820B2

(12) United States Patent
Fels et al.

(10) Patent No.: US 9,399,820 B2
(45) Date of Patent: Jul. 26, 2016

(54) ELECTROLESS NICKEL PLATING BATH

(71) Applicant: Atotech Deutschland GmbH, Berlin (DE)

(72) Inventors: Carl Christian Fels, Berlin (DE); Brigitte Dyrbusch, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 3 days.

(21) Appl. No.: 14/368,589

(22) PCT Filed: Jan. 31, 2013

(86) PCT No.: PCT/EP2013/051889

§ 371 (c)(1),
(2) Date: Jun. 25, 2014

(87) PCT Pub. No.: WO2013/113810

PCT Pub. Date: Aug. 8, 2013

(65) Prior Publication Data

US 2015/0159274 A1 Jun. 11, 2015

(30) Foreign Application Priority Data

Feb. 1, 2012 (EP) ..... 12153540

(51) Int. Cl.

| | |
|---|---|
| ***C23C 18/18*** | (2006.01) |
| ***C23C 18/20*** | (2006.01) |
| ***C23C 18/28*** | (2006.01) |
| ***C23C 18/30*** | (2006.01) |
| ***C23C 18/36*** | (2006.01) |
| ***C23C 18/54*** | (2006.01) |
| ***C23C 18/16*** | (2006.01) |
| ***C23C 18/24*** | (2006.01) |

(52) U.S. Cl.

CPC ..... *C23C 18/165* (2013.01); *C23C 18/1633* (2013.01); *C23C 18/1651* (2013.01); *C23C 18/1653* (2013.01); *C23C 18/24* (2013.01); *C23C 18/285* (2013.01); *C23C 18/30* (2013.01); *C23C 18/36* (2013.01); *C23C 18/54* (2013.01)

(58) Field of Classification Search

CPC .. C23C 18/16; C23C 18/165; C23C 18/1633; C23C 18/1651; C23C 18/1653; C23C 18/2086; C23C 18/24; C23C 18/285; C23C 18/30; C23C 18/36; C23C 18/54; C09D 1/00

USPC ..... 205/183; 427/301, 305, 438, 443.1; 174/254; 106/1.22, 1.27

See application file for complete search history.

(56) References Cited

U.S. PATENT DOCUMENTS

| | | | | |
|---|---|---|---|---|
| 2008/0196625 | A1 | 8/2008 | Bialkowski et al. | |
| 2010/0119713 | A1 * | 5/2010 | Schadow et al. | 427/301 |
| 2010/0155108 | A1 * | 6/2010 | Lee et al. | 174/254 |

FOREIGN PATENT DOCUMENTS

| | | | |
|---|---|---|---|
| JP | 2001342453 | A * | 12/2001 |
| JP | 200582883 | | 3/2005 |
| WO | WO 2006102182 | A2 * | 9/2006 |

OTHER PUBLICATIONS

Kolodynska, "Iminodisuccinic acid as a new complexing agent for removal of heavy metal ions from industrial effluents" Chemical Engineering Journal, vol. 152, Issue 1, Oct. 1, 2009, pp. 277-288.*

English translation of JP2001342453.*

Database WPI Week 201234, Thomson Scientific, London, GB; AN 2012-A51526; XP002678882,& CN 102 286 735 A (Byd Co Ltd) Dec. 21, 2011.

PCT/EP2013/051889; PCT International Search Report and Written Opinion of the International Searching Authority dated May 8, 2014.

PCT/EP2013/051889; PCT International Preliminary Report on Patentability mailed Dec. 11, 2014.

* cited by examiner

*Primary Examiner* — Helene Klemanski

(74) *Attorney, Agent, or Firm* — Renner, Otto, Boisselle & Sklar, LLP

(57) ABSTRACT

The present invention concerns an electroless nickel plating bath suitable for application in plating on plastic processes. The plating bath is free of hazardous substances such as lead ions and ammonia and allows deposition of nickel phosphorous alloys on plastic substrates at plating temperatures not higher than 55° C. Furthermore, the deposition of copper from an immersion type copper plating bath onto the nickel phosphorous coatings require no activation step which results in less process steps and less waste water production.

16 Claims, No Drawings

ELECTROLESS NICKEL PLATING BATH

The present application is a U.S. National Stage Application based on and claiming benefit and priority under 35 U.S.C. §371 of International Application No. PCT/EP2013/051889, filed 31 Jan. 2013, which in turn claims benefit of and priority to European Application No. 12153540.5, filed 1 Feb. 2012, the entirety of each of which is hereby incorporated herein by reference.

FIELD OF THE INVENTION

The invention relates to an electroless nickel plating bath for a low-temperature deposition of nickel phosphorus alloys having a phosphorus content of 4 to 11 wt.-%. The derived nickel phosphorus deposits can be directly coated with copper from an immersion copper plating bath during a plating on plastic process.

BACKGROUND OF THE INVENTION

Plating on plastic processes for decorative and electromagnetic impedance shielding purposes are widely used in the industry. Said processes are applied to various plastic parts such as shower heads, mobile phone covers and radiator grills. One main process route involves an electroless plating step after pre-treatment and activation of the plastic substrate to be coated. The electroless plating methods applied are usually electroless deposition of copper or nickel. The metal or metal alloy layer deposited onto the activated plastic substrate serve as a full area conductive surface for further metal layers deposited later by electroplating methods. The main plastic materials used for said purpose are ABS (acrylonitrile-butadiene-styrene copolymer), ABS/PC blends and PA. The main electroplating processes applied after electroless deposition of copper or nickel are plating of copper, nickel and finally chromium. Such methods are well known in the art and for example described in EP 0 616 053 B1.

In case a nickel alloy is deposited by an electroless plating method the requirements for the electroless nickel plating process and the nickel plating bath used are manifold.

Electroless nickel plating baths capable for deposition of nickel phosphorus alloys having a phosphorus content in the range of 4 to 11 wt.-% are known in the art.

An electroless nickel plating bath useful for deposition of nickel phosphorous alloys onto conducting $SnO_2$ surfaces is disclosed in US 2002/0187266 A1. Said electroless nickel plating bath may contain thiosalicylic acid as a stabilizing agent. However, disclosed plating temperatures are as high as 70° C. and the plating bath requires hazardous substances such as lead ions.

An electroless nickel plating bath comprising sulphide ions together with a sulphide ion controller is disclosed in U.S. Pat. No. 2,762,723. Compounds suitable as sulphide ion controller are selected from inorganic sulphides, other thio compounds, bismuth and lead ions.

SUMMARY OF THE INVENTION

Thus, it is an object of the present invention to provide an electroless nickel plating bath for plating on plastic process which is capable to deposit nickel phosphorous alloys having a phosphorus content in the range of 4 to 11 wt.-%, preferably 6 to 9 wt. %, to deposit said alloys at a plating bath temperature of not higher than 55° C., preferably below 40° C. which saves energy and which does not contain hazardous components such as lead and ammonia. Furthermore it is an object of the present invention to provide an electroless nickel plating bath which allows deposition of nickel phosphorus coatings which can be coated in a successive process step with copper from an immersion copper plating bath without activation of the nickel phosphorus coating by immersing the substrate in e.g., sulphuric acid prior to copper deposition. This leads to a reduced number of process steps and less waste water production.

This object is achieved with an lead- and ammonium-free electroless nickel plating bath according to claim 1 comprising a nickel salt, a hypophosphite compound as reduction agent, a complexing agent mixture, and a stabilizer component mixture.

By applying the plating mechanism according to the present invention using a plating bath described in more detail below nickel phosphorous deposits can be obtained which are low in phosphorous and suited to be directly plated by immersion copper.

Without being bound to it, it is believed that the direct immersion plating on nickel phosphorous deposits obtained by a method of the present invention is possible because of lower phosphorous as well as bismuth content of the nickel deposit, both of which negatively effect the copper deposition.

DETAILED DESCRIPTION OF THE INVENTION

It has been surprisingly found by the inventors that nickel phosphorus coatings on an activated plastic substrate can be deposited from an ammonia- and lead-free electroless nickel plating bath for deposition of nickel phosphorus alloys having a phosphorus content of 4 to 11 wt.-% at low temperatures, which are suited for direct deposition of immersion copper, the plating bath comprising 1.
- i. a source of nickel ions
- ii. a source of hypophosphite ions,
- iii. a complexant mixture comprising
  - a) at least one first complexant selected from the group consisting of hydroxy carboxylic acids, dihydroxy carboxylic acids and salts thereof and
  - b) at least one second complexant selected from the group consisting of iminosuccinic acid, iminodisuccinic acid, salts and derivatives thereof,
- iv. a stabilizer mixture comprising
  - a) bismuth ions, and
  - b) at least one compound selected from the group consisting of mercapto benzoic acids, mercapto carboxylic acids and mercapto sulfonic acids and salts thereof.

The advantages of the inventive electroless nickel plating bath are a) ammonia and lead are not required in the plating bath and b) the activation of a nickel phosphorus layer prior to copper deposition from an immersion copper plating bath is not required.

The inventive electroless nickel plating bath contains nickel ions in a concentration of 0.5 g/l to 5 g/l, more preferred 2.5 g/l to 4 g/l. The source of nickel ions is selected from water soluble nickel salts. Preferred sources of nickel salts are selected from the group comprising nickel chloride, nickel sulphate, nickel methanesulfonate and nickel carbonate.

The inventive electroless nickel plating bath further contains a reducing agent which is selected from hypophosphite compounds such as sodium hypophosphite and potassium hypophosphite. The concentration of hypophosphite ions in the plating bath preferably ranges from 10 g/l to 35 g/l, more preferably from 20 g/l to 27 g/l.

The inventive electroless nickel plating bath further contains a mixture of complexants which is constituted of at least one first complexing agent selected from the group consisting of hydroxy carboxylic acids, dihydroxy carboxylic acids and salts thereof.

The at least one second complexing agent is selected from the group consisting of iminosuccinic acid, iminodisuccinic acid, derivatives thereof and salts thereof.

The at least one first complexing agent is preferably selected from the group consisting of hydroxymalonic acid, glycolic acid, lactic acid, citric acid, mandelic acid, tartaric acid, malic acid, paratartaric acid, succinic acid, aspartic acid and salts thereof. Cations in salts of the at least one first complexing agent are selected from lithium, sodium and potassium. The most preferred first complexing agents are selected from the group consisting of succinic acid, glycinic acid and glycolic acid.

The concentration of the at least one first complexing agent ranges from 1 g/l to 50 g/l, more preferably from 10 g/l to 20 g/l.

The at least one second complexant which is selected from iminosuccinic acid, diiminosuccinic acid, derivatives thereof or salts thereof is selected from the group consisting of iminosuccinic acid, iminodisuccinic acid, derivatives thereof and salts thereof. Cations in salts of iminosuccinic acid derivatives are selected from lithium, sodium and potassium.

The concentration of the at least one second complexing agent ranges from 0.2 g/l to 10 g/l, more preferably from 0.8 g/l to 5 g/l.

The inventive electroless nickel plating bath composition further contains a stabilizer mixture consisting of two components:

a bismuth salt, mercapto benzoic acids, mercapto carboxylic acids and mercapto sulfonic acids and salts thereof.

The bismuth salt added to the electroless nickel plating bath is a water soluble bismuth salt selected from the group consisting of bismuth nitrate, bismuth tartrate, bismuth sulphate, bismuth oxide and bismuth carbonate. The concentration of bismuth ions in the electroless nickel plating bath ranges from 0.5 mg/l to 100 mg/l, preferably from 0.5 mg/l to 30 mg/l, more preferably from 1 mg/l to 30 mg/l.

The mercapto benzoic acid, derivative or salt thereof are selected from the group consisting of 2-mercapto benzoic acid, 3-mercapto benzoic acid, 4-mercapto benzoic acid, salts thereof and mixtures thereof. Preferably the salts of the mercapto benzoic acid or derivative thereof are selected from the group consisting of lithium, sodium and potassium salts and mixtures of the foregoing. The concentration of the at least one mercapto benzoic acid or salt thereof ranges from 0.1 mg/l to 100 mg/l, more preferably 0.5 mg/l to 30 mg/l.

The mercapto carboxylic acid is selected from the group consisting of 3-mercaptopropionic acid, 3-mercapto-2-methylpropionic acid, 2-mercaptopropanoic acid, mercapto acetic acid, 4-mercaptobutyric acid, 3-mercaptoisobutyric acid. Preferably the mercapto carboxylic acid is not mercapto acetic acid. More preferably the mercapto carboxylic acid is selected from the group consisting of 3-mercaptopropionic acid, 3-mercapto-2-methylpropionic acid, 2-mercaptopropanoic acid, 4-mercaptobutyric acid, 3-mercaptoisobutyric acid.

The mercapto sulfonic acid is selected from the group consisting of 2-mercapto-1-ethane sulfonic acid, 3-mercapto-1-propane sulfonic acid, 4-mercapto-1-butane sulfonic acid.

The concentration of the at least one mercapto carboxyl acid or mercapto sulfonic acid or salt thereof ranges from 0.1 mg/l to 100 mg/l, more preferably 0.5 mg/l to 30 mg/l.

The pH value of the inventive nickel phosphorous plating bath ranges from 6.5 to 11.5, preferably 6.5 to 9.0.

The nickel phosphorous plating bath is held at a temperature in the range of 20 to 55° C., preferably in the range of 25 to 35° C., more preferably in the range of 27 to 32° C. during plating.

The plating time ranges from 4 to 120 min.

During the deposition of the nickel alloy, mild agitation of the plating bath generally is employed; its agitation may be a mild air agitation, mechanical agitation, bath circulation by pumping, rotation of a barrel plating, etc. The plating solution may also be subjected to a periodic or continuous filtration treatment to reduce the level of contaminants therein. Replenishment of the constituents of the bath may also be performed, in some embodiments, on a periodic or continuous basis to maintain the concentration of constituents, and in particular, the concentration of nickel ions and hypophosphite ions, as well as the pH level within the desired limits.

The nickel phosphorous plating bath can preferably be employed in the plating of non-conductive plastic substrates, which generally comprises the following steps:

a) provide a conductive seed layer onto the plastic substrate
b) apply a nickel phosphorous coating to said plastic substrate by bringing it into contact with above mentioned plating bath composition,
c) optionally, rinse the such plated plastic substrate with water and
d) apply a copper coating onto the nickel phosphorous coating by bringing the plastic substrate into contact with an immersion copper plating bath comprising copper ions.

No additional activation step of the nickel phosphorous coating is required before the copper immersion plating in step d).

The non-conductive substrates can be activated according to step a) by various methods which are described, for example, in Handbuch der Leiterplattentechnik, Vol. 4, 2003, pages 292 to 300. These processes involve the formation of a conductive layer comprising carbon particles, Pd colloids or conductive polymers. Some of these processes are described in the patent literature and examples are given below:

European patent EP 0 616 053 describes a process for applying a metal coating to a non-conductive substrate (without an electroless coating) comprising:

a. contacting said substrate with an activator comprising a noble metal/Group IVA metal sol to obtain a treated substrate;

b. contacting said treated substrate with a self accelerating and replenishing immersion metal composition having a pH above 11 to pH 13 comprising a solution of;

(i) a Cu(II), Ag, Au or Ni soluble metal salt or mixtures thereof,
(ii) a Group IA metal hydroxide,
(iii) a complexing agent comprising an organic material having a cumulative formation constant log K of from 0.73 to 21.95 for an ion of the metal of said metal salt.

U.S. Pat. No. 5,503,877 describes the metallisation of non-conductive substrates involving the use of complex compounds for the generation of metal seeds on a non-metallic substrate. These metal seeds provide for sufficient conductivity for subsequent electroplating. This process is known in the art as the so-called "Neoganth" process.

Preferably, the following process sequence is applied:

a) provide a conductive seed layer onto the plastic substrate by first etching the substrate, e.g. an ABS plastic substrate, in an aqueous solution containing 100-400 g/l $CrO_3$ and 100-500 g/l sulphuric acid at elevated temperatures between 50 to 80° C., b) apply a nickel phosphorous coating to said plastic substrate by bringing it into contact with above mentioned plating bath composition, c) optionally, rinse the such plated plastic substrate with water and d) apply a copper coating onto the nickel phosphorous coating by bringing the plastic substrate into contact with an immersion copper plating bath comprising copper ions and sulphuric acid.

Generally, immersion copper plating baths contain a source of copper ions, e.g. copper sulphate. The copper ion concentration can vary depending on the plating process. It can for example range between 0.5-1.0 g/l. Generally, it is slightly acidic and contains an inorganic acid like sulphuric acid. Additionally additives like surfactants can be added if required. Such additives are known in the art.

Thereafter, the such coated substrates can be further metallised by electrochemical methods with copper, chromium, nickel etc. known in the art.

EXAMPLES

The invention will now be illustrated by reference to the following non-limiting examples.

Pre-treatment of the ABS substrate material prior to deposition of a nickel phosphorus material applied for all examples:

The ABS substrates were first etched in an aqueous solution containing 360 g/l $CrO_3$ and 360 g/l conc. sulphuric acid heated to 65° C. for 6 min. Next the substrates were rinsed with water, dipped into an aqueous solution of sodium hydrogen sulfite and again rinsed with water. Next, the ABS substrates were dipped into an aqueous solution of 300 ml/l conc. hydrochloric acid, activated for 1 min in an aqueous solution consisting of 300 ml/l conc. hydrochloric acid, 250 mg/l palladium chloride and 17 g/l tin(II)chloride and rinsed with water again.

After deposition of the nickel phosphorus alloy coating from electroless nickel plating baths the ABS substrates of Examples 1 to 4 were rinsed with water and then subjected without any further activation for 2 min to an immersion copper plating bath comprising 0.7 g/l of copper ions and 1.7 g/l conc. sulphuric acid held at 35° C.

The phosphorus content of the nickel phosphorus alloy deposits was measured with AAS (atomic absorption spectrometry) after dissolution of the deposits.

The contact resistivity of the derived copper coating was measured with a standard multimeter and 1 cm distance between the contact tips. The lower the contact resistivity of a sample, the better the coverage of the nickel phosphorus layer coated with copper.

Example 1

According to Invention

A nickel phosphorous alloy was deposited from an aqueous electroless nickel plating bath containing 3.5 g/l nickel ions, 25 g/l hypophosphite ions (corresponding to 11.9 g/l of phosphorous), 5 g/l of citric acid and 2.5 g/l iminodiscuccinic acid as complexant mixture and 2.7 mg/l bismuth ions and 12.8 mg/l 2-mercapto benzoic acid as stabilizer mixture.

The operating temperature of the electroless nickel plating bath was held at 35° C. and the ABS coupons were dipped into the plating baths for 10 min.

A nickel phosphorous alloy deposit having a phosphorous content of 7.9 wt.-% was obtained.

Next the as coated substrate was rinsed with water and then dipped without any activation directly for 2 min in an immersion copper plating bath comprising 0.7 g/l of copper ions and 1.7 g/l conc. sulphuric acid held at 35° C. The whole nickel phosphorous alloy layer was coated with a layer of copper.

The contact resistance of the nickel phosphorous alloy and then copper plated ABS coupons was in the range of 0.1Ω to 1.6 Ω/cm, which corresponds to a high conductivity which is suitable for subsequent electroplating.

Example 2

According to Invention

Example 1 was repeated using an_electroless nickel plating bath containing the same compounds except that 2-mercapto benzoic acid as stabilizer was replaced by 15 mg/l 3-mercaptopropionic acid.

A nickel phosphorous alloy deposit having a phosphorous content of 7.6 wt.-% was obtained.

Next the as coated substrate was rinsed with water and then dipped without any activation directly for 2 min in an immersion copper plating bath comprising 0.7 g/l of copper ions and 1.7 g/l conc. sulphuric acid held at 35° C. The whole nickel phosphorous alloy layer was coated with a layer of copper.

The contact resistance of the nickel phosphorous alloy and then copper plated ABS coupons was in the range of 0.2Ω to 1.4 Ω/cm, which corresponds to a high conductivity which is suitable for subsequent electroplating.

Example 3

Comparative

Example 1 was repeated using an_electroless nickel plating bath containing the same compounds except that 2-mercapto benzoic acid was omitted.

A nickel phosphorous alloy deposit having a phosphorous content of 11.2 wt. % was obtained.

No immersion plating of copper was possible when treating the deposited nickel phosphorous alloy with a copper immersion plating solution described above.

The contact resistance of the nickel phosphorous alloy was in the range of 40Ω to 60 Ω/cm.

Example 4

Comparative

Example 1 was repeated using an_electroless nickel plating bath containing the same compounds except that iminodisuccinic acid was omitted.

A nickel phosphorous alloy deposit having a phosphorous content of 11.2 wt. % was obtained.

No immersion plating of copper was possible when treating the deposited nickel phosphorous alloy with a copper immersion plating solution described above.

The contact resistance of the nickel phosphorous alloy was in the range of 50Ω to 70 Ω/cm.

Example 5

According to Invention

A nickel phosphorous alloy was deposited from an aqueous electroless nickel plating bath containing 3.5 g/l nickel ions, 25 g/l hypophosphite ions (corresponding to 11.9 g/l of phosphorous), 5 g/l of citric acid and 2.5 g/l iminodiscuccinic acid as complexant mixture and 1 mg/l bismuth ions and 2 mg/l 2-mercapto benzoic acid as stabilizer mixture. The pH value of the electroless nickel plating bath was 8.0.

The operating temperature of the electroless nickel plating bath was held at 35° C. and the ABS coupons were dipped into the plating bath for 10 min.

A nickel phosphorous alloy deposit having a phosphorous content of 7.23 wt.-% and a bismuth content of 0.19 wt.-% was obtained. The deposition rate was 1.53 μm/h.

Example 6

According to Invention

Example 5 was repeated using an electroless nickel plating bath containing the same compounds except that 2-mercapto benzoic acid as stabilizer was replaced by 5 mg/l mercapto acetic acid.

A nickel phosphorous alloy deposit having a phosphorous content of 8.5 wt.-% and a bismuth content of 0.13 wt.-% was obtained. The deposition rate was 1.40 μm/h.

Example 7

Comparative

Example 5 was repeated using an electroless nickel plating bath containing the same compounds except that iminodisuccinic acid in the complexant mixture was replaced by 2.5 g/l succinic acid.

A nickel phosphorous alloy deposit having a phosphorous content of 11.4 wt.-% and a bismuth content of 0.22 wt.-% was obtained. The deposition rate was 1.43 μm/h.

Example 8

Comparative

Example 5 was repeated using an electroless nickel plating bath containing the same compounds except that 2-mercapto benzoic acid as stabilizer was replaced by 2 mg/l thiodiglycolic acid.

A nickel phosphorous alloy deposit having a phosphorous content of 12.4 wt.-% and a bismuth content of 0.22 wt.-% was obtained. The deposition rate was 1.28 μm/h.

Example 9

According to Invention

A nickel phosphorous alloy was deposited from an aqueous electroless nickel plating bath containing 3.5 g/l nickel ions, 25 g/l hypophosphite ions (corresponding to 11.9 g/l of phosphorous), 5 g/l of citric acid and 2.5 g/l iminodiscuccinic acid as complexant mixture and 4 mg/l bismuth ions and 5 mg/l 2-mercapto benzoic acid as stabilizer mixture. The pH value of the electroless nickel plating bath was 8.6.

The operating temperature of the electroless nickel plating bath was held at 35° C. and the ABS coupons were dipped into the plating bath for 10 min.

A nickel phosphorous alloy deposit having a phosphorous content of 8.9 wt.-% was obtained.

Example 10

According to Invention

Example 9 was repeated using an electroless nickel plating bath containing the same compounds except that 2-mercapto benzoic acid as stabilizer was replaced by 5 mg/l 3-mercapto-1-propane sulfonic acid.

A nickel phosphorous alloy deposit having a phosphorous content of 8.6 wt.-% was obtained.

The invention claimed is:

1. An ammonia- and lead-free electroless nickel plating bath for deposition of nickel phosphorus alloys having a phosphorus content of 6 to 9 wt.-% comprising i. a source of nickel ions, at a concentration of 2.5 g/l to 4 g/l, ii. a source of hypophosphite ions, at a concentration of 20 g/l to 27 g/l, iii. a complexant mixture comprising a) at least one first complexant at a concentration of from 1 g/l to 50 g/l selected from the group consisting of hydroxy carboxylic acids, dihydroxy carboxylic acids and salts thereof and b) at least one second complexant at a concentration of from 0.2 g/l to 10 g/l selected from the group consisting of iminosuccinic acid, iminodisuccinic acid, salts and derivatives thereof, iv. a stabilizer mixture comprising a) bismuth ions, at a concentration of 0.5 mg/l to 30 mg/l and b) at least one compound selected from the group consisting of mercapto benzoic acids, mercapto carboxylic acids and mercapto sulfonic acids and salts thereof, at a concentration of 0.1 mg/l to 100 mg/l, wherein the bath has a pH in the range from 6.5 to 11.5.

2. An electroless nickel plating bath according to claim 1 wherein the at least one first complexant is selected from the group consisting of hydroxymalonic acid, glycolic acid, lactic acid, citric acid, mandelic acid, tartaric acid, malic acid, paratartaric acid, succinic acid, aspartic acid and salts thereof.

3. An electroless nickel plating bath according to claim 1 wherein the concentration of the at least one first complexant ranges from 10 g/l to 20 g/l.

4. An electroless nickel plating bath according to claim 1 wherein the concentration of the at least one second complexant ranges from 0.8 g/l to 5 g/l.

5. An electroless nickel plating bath according to claim 1 wherein the concentration of bismuth ions ranges from 1 mg/l to 30 mg/l.

6. An electroless nickel plating bath according to claim 1 wherein the mercapto benzoic acid derivative is selected from the group consisting of 2-mercapto benzoic acid, 3-mercapto benzoic acid, 4-mercapto benzoic acid, salts thereof and mixtures thereof.

7. An electroless nickel plating bath according to claim 1 wherein the mercapto carboxylic acid is selected from the group consisting of 3-mercaptopropionic acid, 3-mercapto-2-methylpropionic acid, 2-mercaptopropanoic acid, mercapto acetic acid, 4-mercaptobutyric acid and 3-mercaptoisobutyric acid.

8. An electroless nickel plating bath according to claim 1 wherein the mercapto sulfonic acid is selected from the group consisting of 2-mercapto-1-ethane sulfonic acid, 3-mercapto-1-propane sulfonic acid, and 4-mercapto-1-butane sulfonic acid.

9. An electroless nickel plating bath according to claim 1 wherein the concentration of the mercapto benzoic acids, mercapto carboxylic acids and mercapto sulfonic acids and salts thereof ranges from 0.5 mg/l to 30 mg/l.

10. A method for metal plating of non-conductive substrates, which comprises the following steps:

i. providing a conductive seed layer onto the non-conductive substrate;

ii. applying a nickel phosphorous coating to said non-conductive substrate by bringing it into contact with a plating bath composition according to claim 1 at a temperature in the range of 25 to 35° for a time ranging from 4 to 120 min;

iii. optionally, rinsing the such plated substrate with water; and iv. applying a copper coating onto the nickel phosphorous coating by bringing the plastic substrate into contact with an immersion copper plating bath comprising copper ions, wherein a nickel phosphorus alloy having a phosphorus content of 6 to 9 wt.-% is deposited on the substrate.

11. A method according to claim 10, wherein the plating temperature ranges between 27-32°.

12. A method according to claim 10, wherein the non-conductive substrate is a plastic substrate made of ABS or ABS/PC blend.

13. A method according to claim 10, further comprising v. applying at least one electrolytically deposited metal layer onto the immersion copper layer deposited in step iv., wherein the at least one electrolytically deposited layer is selected from copper, nickel, chromium or its alloys.

14. A method according to claim 11, wherein the non-conductive substrate is a plastic substrate made of ABS or ABS/PC blend.

15. A method according to claim 11, further comprising v. applying at least one electrolytically deposited metal layer onto the immersion copper layer deposited in step iv., wherein the at least one electrolytically deposited layer is selected from copper, nickel, chromium or its alloys.

16. A method according to claim 12, further comprising v. applying at least one electrolytically deposited metal layer onto the immersion copper layer deposited in step iv., wherein the at least one electrolytically deposited layer is selected from copper, nickel, chromium or its alloys.

* * * * *